US008737858B2

(12) United States Patent
Namba

(10) Patent No.: US 8,737,858 B2
(45) Date of Patent: May 27, 2014

(54) TRANSFER DEVICE AND IMAGE FORMING APPARATUS

(75) Inventor: Haruyuki Namba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 596 days.

(21) Appl. No.: 13/027,741

(22) Filed: Feb. 15, 2011

(65) Prior Publication Data

US 2012/0076525 A1 Mar. 29, 2012

(30) Foreign Application Priority Data

Sep. 24, 2010 (JP) ..... 2010-214289

(51) Int. Cl.
*G03G 15/16* (2006.01)
*G03G 15/20* (2006.01)

(52) U.S. Cl.
USPC ..... 399/66; 399/313

(58) Field of Classification Search
USPC ..... 399/66, 90, 313, 314
See application file for complete search history.

(56) References Cited

FOREIGN PATENT DOCUMENTS

| | | |
|---|---|---|
| JP | H-A-9-34278 | 2/1997 |
| JP | A-2006-84730 | 3/2006 |
| JP | A-2006-84731 | 3/2006 |

OTHER PUBLICATIONS

Feb. 12, 2014 Office Action issued in Japanese Application No. 2010-214289 (with English Translation).

*Primary Examiner* — David Gray
*Assistant Examiner* — Erika J Villaluna
(74) *Attorney, Agent, or Firm* — Oliff PLC

(57) ABSTRACT

An image forming apparatus, having: a transfer device that adjusts a second charge amount so that a first charge amount of charges which flow toward a core from the region of a conductive layer which comes into contact with a power feeding member when a voltage is applied to the power feeding member from a power source becomes greater than the second charge amount of charges which flow toward the region which comes into contact with an intermediate transfer body from the core.

17 Claims, 6 Drawing Sheets

TRANSFER DEVICE AND IMAGE FORMING APPARATUS

CROSS-REFERENCE TO RELATED APPLICATION

This application is based on and claims priority under 35 USC 119 from Japanese Patent Application No. 2010-214289 filed on Sep. 24, 2010.

BACKGROUND

1. Technical Field

The present invention relates to a transfer device and an image forming apparatus.

2. Related Art

As a transfer member used for an electrophotographic image forming apparatus, a transfer roller in which a conductive layer is provided on a core thereof is known. In the electrophotographic image forming apparatus, a toner image on an image carrier is transferred to a transfer-receiving member, such as a recording medium or an intermediate transfer body, by applying a voltage to the transfer roller and allowing an electric current to flow between the transfer roller and the image carrier.

SUMMARY

According to a first aspect of the invention, there is provided a transfer device including a transfer member that is arranged so as to face an image carrier that carries a toner image on the surface thereof via a transfer-receiving member, that comprises a conductive layer including an ion conductive agent on a conductive core, and that transfers the toner image carried on the surface of the image carrier to the transfer-receiving member; a voltage application unit, that is arranged in contact with a surface of the transfer member, and that applies a voltage to the transfer member from the surface thereof; and an adjusting unit that adjusts a second charge amount so that a first charge amount of charges that flow toward the conductive core from the region of the conductive layer that comes into contact with the voltage application unit becomes greater than the second charge amount of charges that flow toward a region of the conductive layer that faces the image carrier from the core, due to a voltage being applied to the transfer member from the voltage application unit.

BRIEF DESCRIPTION OF THE DRAWINGS

Exemplary embodiments of the present invention will be described in detail based on the following figures, wherein.

DETAILED DESCRIPTION

Figure 1:
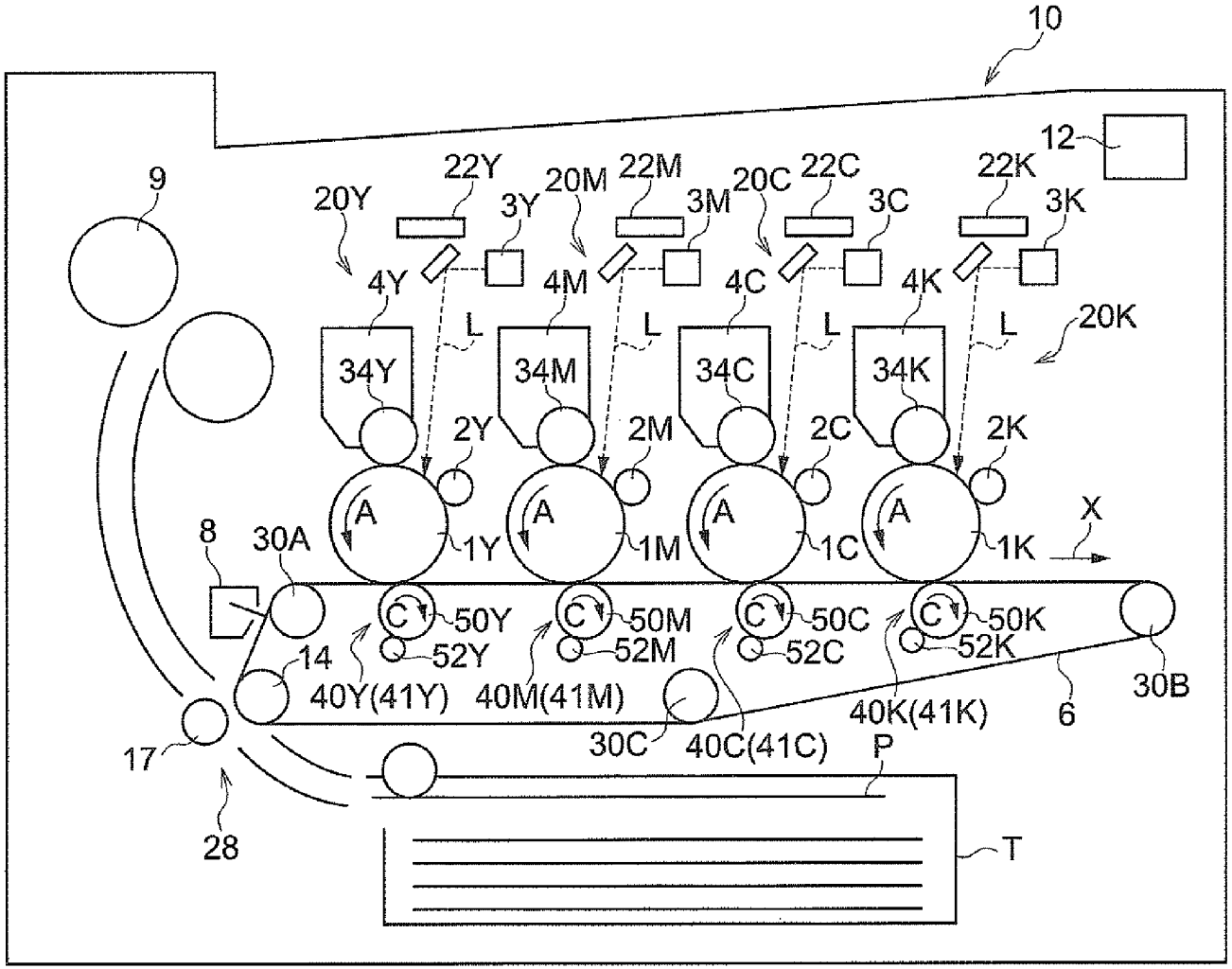
FIG. 1 is a schematic construction diagram showing an example of an image forming apparatus according to an exemplary embodiment of the present invention.

A second aspect of the invention is the transfer device according to the first aspect of the invention in which the adjusting unit includes: a first wiring line that grounds the core; and a first adjusting unit that adjusts a charge amount of charges that flow into the first wiring line so that some of charges, flowing toward the conductive core from the region of the conductive layer that comes into contact with the voltage application unit, flow toward the first wiring line via the core.

A third aspect of the invention is the transfer device according to the second aspect of the invention in which the first adjusting unit includes any of a resistance device, a constant voltage device, or a constant current source.

A fourth aspect of the invention is the transfer device according to any one of the first to third aspects of the invention in which the adjusting unit has a first wiring line that grounds the conductive core; a switching unit that switches the first wiring line to an electrical connection state or an electrical disconnection state; a moving unit that moves the image carrier so that the image carrier is brought into a contact state of contacting the transfer-receiving member or a non-contact state of being separated from the transfer-receiving member; and a control unit that controls the switching unit and the moving unit so that the first wiring line is brought into the electrical disconnection state and the image carrier is brought into the contact state at a time of image formation when the toner image carried on the image carrier is transferred to the transfer-receiving member, and that controls the switching unit and the moving unit so that the first wiring line is brought into the electrical connection state and the image carrier is brought into the non-contact state at times of image non-formation that are other than the time of image formation.

A fifth aspect of the invention is the transfer device according to any one of the first to forth aspects of the invention in which the image carrier carries the toner image on the surface thereof via an intermediate transfer body, and the transfer member, that comprises the conductive layer comprising the ion conductive agent on the conductive core, transfers the toner image carried on the surface of the image carrier to the intermediate transfer body; the voltage application unit comprises a power feeding member and a power source; and the adjusting unit adjusts the second charge amount so that the first charge amount, which is an integrated value of the charge amount of charges that flow toward the conductive core from the region of the conductive layer that comes into contact with the power feeding member in the entire period when a voltage is applied to the transfer member via the power feeding member from the power source, becomes greater than the second charge amount, which is an integrated value of the charge amount of charges that flow toward the region that is brought into contact with the intermediate transfer body from the conductive core.

A sixth aspect of the invention is the transfer device according to any one of the first to fifth aspects of the invention in which the adjusting unit adjusts the second charge amount so that the first charge amount falls within the range of from about 1.1 times to about 2 times the second charge amount.

A seventh aspect of the invention is the transfer device according to any one of the first to fifth aspects of the invention in which the adjusting unit adjusts the second charge amount so that the first charge amount falls within the range of from about 1.1 times to about 1.5 times the second charge amount.

An eighth aspect of the invention is the transfer device according to any one of the first to seventh aspects of the invention in which the ion conductive agent includes at least one compound selected from the group consisting of quaternary ammonium salts, aliphatic sulfonates, higher alcohol sulfate ester salts, higher alcohol-ethylene-oxide-added sulfate ester salts, higher alcohol phosphoric acid ester salts, higher alcohol-ethylene-oxide-added phosphoric acid ester salts, betaines, higher alcohol ethylene oxides, polyethylene glycol fatty acid esters, and polyhydric alcohol fatty acid esters.

A ninth aspect of the invention is the transfer device according to any one of the first to seventh aspects of the invention in which the ion conductive agent includes at least one quaternary ammonium salt.

A tenth aspect of the invention is the transfer device according to the ninth aspects of the invention in which the quaternary ammonium salt includes modified fatty acid/dimethylethyl ammonium perchlorate, tetraethyl ammonium tetrafluoroborate, or lauryl trimethyl ammonium chloride.

An eleventh aspect of the invention is the transfer device according to any one of the first to tenth aspects of the invention in which the conductive layer includes the ion conductive agent dispersed in a binder material.

A twelfth aspect of the invention is the transfer device according to any one of the first to eleventh aspects of the invention in which the conductive layer include a urethane foam layer comprising the ion conductive agent.

A thirteenth aspect of the invention is the transfer device according to any one of the first to twelfth aspects of the invention in which the conductive layer includes an epichlorohydrin rubber and an acrylonitrile-butadiene copolymer rubber.

A fourteenth aspect of the invention is the transfer device according to any one of the first to thirteenth aspects of the invention in which the core includes stainless steel.

A fifteenth aspect of the invention is the transfer device according to any one of the first to fourteenth aspects of the invention in which the conductive toner is charged so as to have negative polarity.

A sixteenth aspect of the invention is an image forming apparatus having the transfer device according to any one of the first to fifteenth aspects of the invention.

A seventeenth aspect of the invention is the image forming apparatus according to sixteenth aspect of the invention in which the transfer device is attached to and detached from the image forming apparatus.

One embodiment will be described below in detail with reference to the drawings.

First Embodiment

An example of an image forming apparatus of the present embodiment is shown in FIG. 1.

As shown in FIG. 1, an image forming apparatus 10 of the present embodiment includes an annular intermediate transfer body 6 which rotates in a predetermined direction (in the direction of an arrow X in FIG. 1), plural image forming section 20Y, image forming section 20M, image forming section 20C, and image forming section 20K which are arrayed along a rotational direction of the intermediate transfer body 6, a transfer member 50Y, a transfer member 50M, a transfer member 50C, and a transfer member 50K which are provided corresponding to the image forming section 20Y, the image forming section 20M, the image forming section 20C, and the image forming section 20K, respectively, and a main control section 12 which controls the respective apparatus sections provided in the image forming apparatus 10.

The image forming section 20Y includes an image carrier 1Y which rotates in the direction of an arrow A in FIG. 1, a charger 2Y which charges the surface of the image carrier 1Y, a latent image forming device 3Y which exposes the surface of the charged image carrier 1Y by exposure light modulated on the basis of image information of Y color (yellow color), and forms an electrostatic latent image on the image carrier 1Y, a developing roll 34Y which holds Y color developer, and a developing device 4Y which develops the electrostatic latent image formed on the image carrier 1Y by the Y color developer, and forms a toner image (Y color) on the image carrier 1Y.

Similarly, the image forming section 20M includes an image carrier 1M which rotates in the direction of an arrow A in FIG. 1, a charger 2M which charges the surface of the image carrier 1M, a latent image forming device 3M which exposes the surface of the charged image carrier 1M by exposure light modulated on the basis of image information of M color (magenta color), and forms an electrostatic latent image on the image carrier 1M, a developing roll 34M which holds M color developer, and a developing device 4M which develops the electrostatic latent image formed on the image carrier 1M by the M color developer, and forms a toner image (M color) on the image carrier 1M.

Similarly, the image forming section 20C includes an image carrier 1C which rotates in the direction of an arrow A in FIG. 1, a charger 2C which charges the surface of the image carrier 1C, a latent image forming device 3C which exposes the surface of the charged image carrier 1C by exposure light modulated on the basis of image information of C color (cyan color), and forms an electrostatic latent image on the image carrier 1C, a developing roll 34C which holds C color developer, and a developing device 4C which develops the electrostatic latent image formed on the image carrier 1C by the C color developer, and forms a toner image (C color) on the image carrier 1C.

Similarly, the image forming section 20K includes an image carrier 1K which rotates in the direction of an arrow A in FIG. 1, a charger 2K which charges the surface of the image carrier 1K, a latent image forming device 3K which exposes the surface of the charged image carrier 1K by exposure light modulated on the basis of image information of K color (black color), and forms an electrostatic latent image on the image carrier 1K, a developing roll 34K which holds K color developer, and a developing device 4K which develops the electrostatic latent image formed on the image carrier 1K by the K color developer, and forms a toner image (K color) on the image carrier 1K.

Since materials and configurations of the devices and individual members included in the image forming section 20Y, the image forming section 20M, the image forming section 20C, and the image forming section 20K includes heretofore-known materials and configurations used for an electrophotographic image forming apparatus, the detailed description thereof is omitted herein.

Additionally, when individual constituent elements provided for each of the above Y color (yellow), M color (magenta), C color (cyan), and K color (black) are described below without distinguishing each color, subscripts Y, M, C, and K at the ends of the reference numerals may be omitted in the description.

Figure 2:
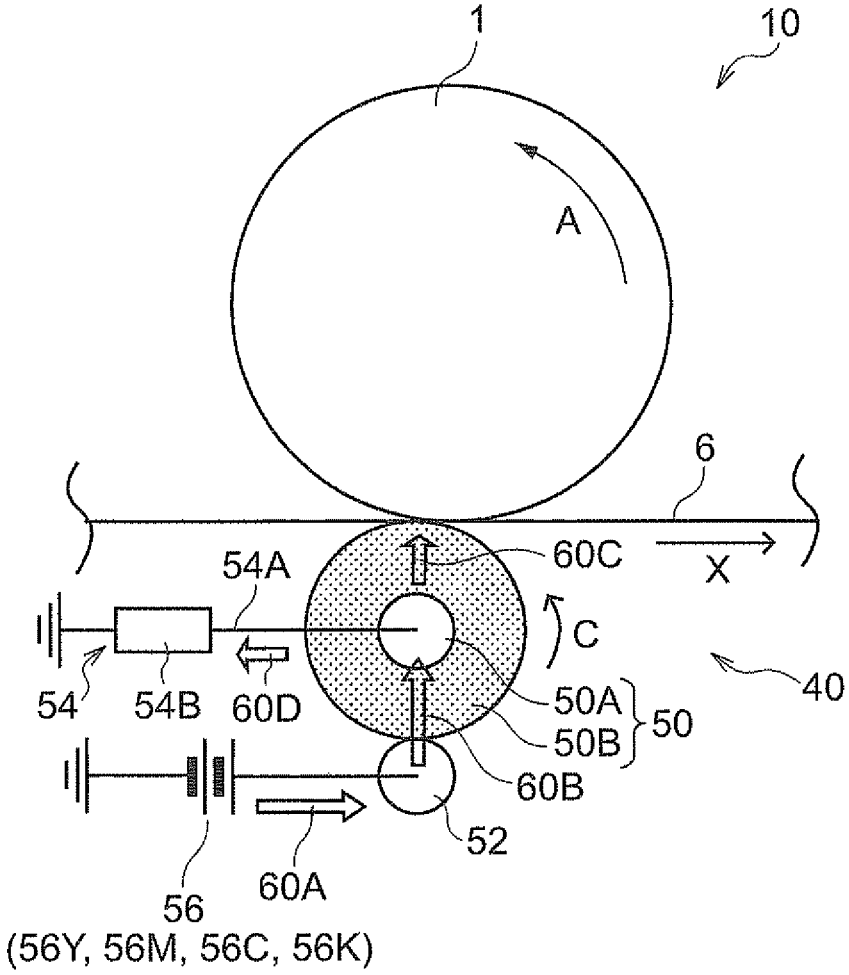
FIG. 2 is an enlarged schematic view showing a transfer device of a first exemplary embodiment of the present invention.

A transfer device 40 (each of a transfer device 40Y, a transfer device 40M, a transfer device 40C, and a transfer device 40K) provided in the image forming section 20 for each color, as shown in FIG. 2, includes a columnar transfer member 50 (a transfer member 50Y, a transfer member 50M, a transfer member 50C, or a transfer member 50K), a columnar power feeding member 52 (a power feeding member 52Y, a power feeding member 52M, a power feeding member 52C, or a power feeding member 52K) arranged in contact with the outside of the transfer member 50, and a power source 56 (a power source 56Y, a power source 56M, a power source 56C, or the power source 56K) which applies a voltage to the power feeding member 52.

The transfer member 50 primarily transfers a toner image on the image carrier 1 to the outer side of the intermediate transfer body 6. In the image forming apparatus 10 of the present embodiment, the transfer member 50 is constructed so that a conductive layer 50B containing an ion conductive agent is provided on a conductive and columnar core 50A. The conductive layer 50B is made conductive or semi-conductive.

In addition, in the present embodiment, the term "conductive" means that the volume resistivity is less than $10^7$ Ω·cm. Additionally, the term "semi-conductive" means that the volume resistivity is from $10^7$ Ω·cm to $10^{13}$ Ω·cm.

Examples of the core 50A includes metal or alloy materials, such as iron, copper, brass, stainless steel, aluminum, or nickel; and conductive resins.

The conductive layer 50B contains an ion conductive agent, and the resistance value (volume resistivity) of the conductive layer 50B is adjusted as the content of this ion conductive agent is adjusted. The conductive layer 50B may be a conductive or semi-conductive layer containing the ion conductive agent. Examples of the conductive layer include a layer in which the ion conductive agent is dispersed in a binder material.

This binder material includes, for example, rubber materials, such as polyurethane, SBR (styrene butadiene rubber), BR (polybutadiene rubber), high styrene rubber (Hi styrene resin masterbatch), IR (isoprene rubber), IIR (butyl rubber), halogenated butyl rubber, NBR (nitrile butadiene rubber), hydrogenated NBR (H-NBR), EPDM (ethylene propylene diene terpolymer rubber), EPM (ethylene propylene rubber), rubber blends of NBR and EPDM, CR (chloroprene rubber), ACM (acrylic rubber), CO (hydrin rubber), ECO (epichlorohydrin rubber), chlorinated polyethylene (chlorinated-PE), VAMAC (ethylene acrylic rubber), VMQ (silicone rubber), AU (urethane rubber), FKM (fluoro rubber), NR (natural rubber), and CSM (chlorosulfonated polyethylene rubber).

Examples of the ion conductive agent included in the conductive layer 50B include quaternary ammonium salts (such as perchlorates, chlorates, hydrofluoroborate salt, sulfates, ethosulfates, and halogenated benzyl salt (benzyl bromide salt, benzyl chloride salt, or the like) of lauryl trimethyl ammonium, stearyl trimethyl ammonium, octadodecyl trimethyl ammonium, dodecyl trimethyl ammonium, hexadecyl trimethyl ammonium, modified fatty acid/dimethylethyl ammonium, or the like), aliphatic sulfonates, higher alcohol sulfate ester salts, higher alcohol-ethylene-oxide-added sulfate ester salts, higher alcohol phosphoric acid ester salts, higher alcohol-ethylene-oxide-added phosphoric acid ester salts, various betaines, higher alcohol ethylene oxide, polyethylene glycol fatty acid ester, and polyhydric alcohol fatty acid ester. Among these, it is desirable to use quaternary ammonium salt from the viewpoints of a current-carrying resistance change. In addition, these ion conductive agents may be used alone, or plural kinds of ion conductive agents may be used in combination.

The power feeding member 52 is a conductive member, and is arranged in contact with the outer peripheral side (i.e., conductive layer 50B) of the transfer member 50. In the present embodiment, the power feeding member 52 is formed in a columnar shape, and is electrically connected to the power source 56. The power source 56 has a terminal at one end connected electrically to the power feeding member 52 and a terminal at the other end is grounded. When a voltage is applied to the power feeding member 52 from the power source 56, the voltage is applied to the transfer member 50 from the region of the transfer member 50 in contact with the power feeding member 52. Also, as an electric field, by which a toner image carried on the image carrier 1 shifts to the intermediate transfer body 6 side (transfer member 50 side), is formed between the transfer member 50 and the image carrier 1 by the application of the voltage to the transfer member 50, the toner image on the image carrier 1 is transferred to the intermediate transfer body 6.

Although the polarity of a voltage to be applied to the surface (conductive layer 50B) of the transfer member 50 via the power feeding member 52 from the power source 56 may be positive or may be negative, it is desirable that the polarity is positive. The reason why the positive polarity is desirable will be described below.

The intermediate transfer body 6 is formed in an annular shape (a belt shape), and is supported by the above transfer member 50, plural columnar member 30A, columnar member 30B, and columnar member 30C, and a back-up roll 14, which are provided therein. As at least one of the transfer member 50, the plural columnar member 30A, columnar member 30B, and columnar member 30C, and the back-up roll 14 is rotationally driven, and the other members are driven and rotated, the intermediate transfer body 6 is rotated in the direction (the direction of the arrow X in FIG. 1) opposite to the rotational direction (the direction of the arrow A in FIG. 1) of the image carrier 1. An example of the intermediate transfer body 6 includes an intermediate transfer body of heretofore-known materials and configurations used for an electrophotographic image forming apparatus.

Additionally, the image forming apparatus 10, as shown in FIG. 1, includes a secondary transfer device 28 which secondarily transfers a toner image on the intermediate transfer body 6 to a recording medium P, a fixing device 9 which fixes the toner image transferred to the recording medium P, a paper tray T which stores the recording medium P, a removing member (not shown) which removes deposits on the surface of each image carrier 1, a charge remover (not shown) which removes residual charges on the surface of each image carrier 1, and a belt cleaner 8 which cleans the surface of the intermediate transfer body 6.

The secondary transfer device 28 includes the columnar or cylindrical back-up roll 14 which is arranged inside the annular intermediate transfer body 6, a columnar or cylindrical secondary transfer member 17 which is arranged outside the intermediate transfer body 6 so as to face the back-up roll 14 via the intermediate transfer body 6.

The respective apparatus sections provided in the image forming apparatus 10 are electrically connected to the main control section 12.

In the image forming apparatus 10 constructed as described above, when printing data including image data of an image to be formed on the recording medium P in the image forming apparatus 10 is input to the main control section 12 via an input/output section (not shown), this printing data is output to an image forming control section 22 corresponding to each color after being decomposed into image information of each color (Y, M, C, or K) in the main control section 12. Then, the latent image forming device 3 in each image forming section 20 is controlled by the control of the image forming control section 22 whereby a laser beam L is modulated. Then, the surface of the image carrier 1 is irradiated with the modulated laser beam L. As the surface of each image carrier 1 is irradiated with the laser beam L, an electrostatic latent image according to image information of the corresponding color is formed on each image carrier 1. Subsequently, the electrostatic latent image on each image carrier 1 is developed with a toner by the developing device 4 in which each color toner is stored, and a toner image is formed on each image carrier 1.

The toner image formed on each image carrier 1 is primarily transferred sequentially to the outer side of the intermediate transfer body 6 by the transfer device 40. In each image carrier 1 where this primary transfer is ended, deposits, such as a residual toner deposited on the surface of the image carrier, are removed by the removing member (not shown), and residual charges are removed by the charge remover (not shown).

The toner image, which has been primarily transferred sequentially to the outer side of the intermediate transfer body 6 by the above image forming section 20 (the image forming section 20Y, the image forming section 20M, the image forming section 20C, or the image forming section 20K), moves with the rotation (the direction of the arrow X in FIGS. 1 and 2) of the intermediate transfer body 6, and is secondarily transferred to the recording medium P transported to the position of the secondary transfer device 28 from the paper tray T by a transporting member (not shown). The toner image secondarily transferred to the recording medium P is fixed on the recording medium P by the fixing device 9. As a result, a desired image is formed on the recording medium P.

In addition, in the following description of the present embodiment, a series of processes of secondarily transferring the toner image primarily transferred to the outside of the intermediate transfer body 6 to the recording medium P, thereby forming an image on the recording medium P, is referred to as "image forming processing".

Additionally, in the following description, a period other than the above "image forming processing", i.e., a period when no image is formed on the recording medium P during a period when electric power is supplied from the power source (not shown) to the respective apparatus sections of the image forming apparatus 10, is referred to as "a time of image non-formation".

Here, as described above, in a case where the transfer member 50 in the transfer device 40 is constructed so that the conductive layer 50B is provided on the core 50A and is constructed so that an ion conductive agent is contained in the conductive layer 50B, it is presumed that variations in resistance within the conductive layer 50B may be suppressed compared to the case where conductive agents other than ion conductive agents, such as an electronic conductive agent, are contained in the conductive layer 50B. However, in a case where the conductive layer 50B provided in the transfer member 50 is constructed so as to contain an ion conductive agent, and a voltage is applied to the core 50A of the transfer member 50 instead of the outer peripheral surface (conductive layer 50B) of the transfer member 50, it is likely that the ion conductive agent in the conductive layer 50B has flowed in the circumferential direction of the conductive layer 50B, polarization occurs within the conductive layer 50B, and the resistance value of the conductive layer 50B changes.

On the other hand, in a case where the conductive layer 50B provided in the transfer member 50 is constructed so as to contain an ion conductive agent and a voltage is applied to the outer peripheral side (conductive layer 50B) of the transfer member 50, it is presumed that, whenever the transfer member 50 performs half a cycle, the direction of an electric field is reversed by rotation (rotation in the direction opposite to the image carrier 1; refer to the direction of a rotation arrow C in FIGS. 1 and 2) of the transfer member 50 accompanying individual rotations of both the intermediate transfer body 6 and the image carrier 1, and the polarization of the conductive layer 50B is suppressed. However, since the mobility (a ratio of mobile ions among all of ions contained in the conductive layer 50B) of ions within the conductive layer 50B containing the ion conductive agent changes depending on environmental temperature, environmental humidity, or the like, even when a voltage is applied to the outer peripheral side of the transfer member 50, it is likely that it becomes difficult to suppress the polarization occurring within the conductive layer 50B depending on environmental temperature or environmental humidity, and it may be difficult to suppress change in the resistance value of the conductive layer 50B.

Additionally, in a case where the polarity of a voltage to be applied to the surface (conductive layer 50B) of the transfer member 50 is made positive, there is a case where a change in resistance value accompanying the duration time of the voltage application may become conspicuous when compared to a case where the polarity of the voltage is made negative in particular.

Thus, the transfer device 40 (each of the transfer device 40Y, the transfer device 40M, the transfer device 40C, and the transfer device 40K) provided in the image forming apparatus 10 of the present embodiment further includes an adjusting member 54 in addition to the transfer member 50, the power feeding member 52 arranged in contact with the outside of the transfer member 50, and the power source 56 which applies a voltage to the power feeding member 52.

The adjusting member 54 functions to adjust a second charge amount so that, as a voltage is applied to the power feeding member 52 from the power source 56 (refer to an arrow 60A in FIG. 2), a first charge amount of charges (refer to an arrow 60B in FIG. 2) which flow through the inside of the conductive layer 50B toward the core 50A from a region of the conductive layer 50B which comes into contact with the power feeding member 52 becomes greater than the second charge amount of charges (refer to the arrow 60C in FIG. 2) which flow through the inside of the conductive layer 50B toward a region (region which faces the image carrier 1) of the conductive layer 50B which comes into contact with the intermediate transfer body 6 from the core 50A.

In addition, although the adjusting member 54 may adjust the second charge amount so that the first charge amount becomes greater than the second charge amount, it is desirable to make an adjustment so that the first charge amount falls within a range of from about 1.1 times to about 2 times, or from 1.1 times to 2 times the second charge amount, and it is more desirable to make an adjustment so that the first charge amount falls within a range of from about 1.1 times to and about 1.5 times, or from 1.1 times to 1.5 times the second charge amount.

The first charge amount and the second charge amount are measured by the following methods. In detail, the first charge amount is measured by an ammeter arranged between the power source 56 and the power feeding member 52. Additionally, the second charge amount is measured as a difference between a current value indicating the first charge amount, and a current value measured by an ammeter arranged between the core 50A and the adjusting member.

Although the adjusting member 54 may be a member having the above function, specifically, the adjusting member may include a first wiring line 54A and an adjusting element 54B provided in the first wiring line 54A (refer to FIG. 2).

The first wiring line 54A has one end electrically connected to the core 50A and the other end grounded. The adjusting device 54B is provided in the first wiring line 54A to adjust the amount of charges which flow into the first wiring line 54A so that some of charges which have flowed toward the core 50A from the region of the conductive layer 50B which comes into contact with the power feeding member 52 flow toward the first wiring line 54A via the core 50A.

Examples of the adjusting device 54B includes, specifically, a resistance device in which the resistance value is set to become lower compared to the resistance value (volume resistance value) of the conductive layer 50B in the thickness direction; a constant voltage device which applies the constant voltage of a voltage value smaller than the absolute value of the voltage value of a voltage to be applied from the power feeding member 52 to the transfer member 50; and a constant current source which generates the constant current of a current value smaller than the absolute value of the value of an electric current which flows through the inside of the conductive layer 50B toward the core 50A from the region of the conductive layer 50B which comes into contact with the power feeding member 52.

In addition, among the resistance device, the constant voltage device, and the constant current source, as the adjusting device 54B, it is desirable to use the constant voltage device or the constant current source and it is more desirable to use the constant current source, from viewpoints of reducing the voltage value of a voltage to be applied from the power feeding member 52 to the transfer member 50.

Additionally, although the voltage value of a voltage applied by the constant voltage device may be a voltage value smaller than the absolute value of the voltage value of a voltage to be applied from the power feeding member 52 to the transfer member 50 as described above, it is desirable to set the same voltage value as the potential of the core 50A when the voltage from the power feeding member 52 to the transfer member 50 is applied in a state where the core 50A is electrically opened.

By setting such a voltage value, charge does not flow into the first wiring line 54A in a state where the resistance value of the conductive layer 50B does not rise, and charges flow into the first wiring line 54A when the resistance value of the conductive layer 50B begins to rise. For this reason, in accordance with the rise in the resistance of the conductive layer 50B, charges escape from the core 50A, and the rise in the resistance value of the conductive layer 50B is suppressed.

In addition, in the present embodiment, a case where the resistance value of the resistance device, the voltage value of the constant voltage device, and the current value of the constant current source, which devices are mentioned above as examples of the adjusting device 54B, are preset for each adjusting device 54B will be described. However, the resistance value, the voltage value, and the current value may be changed so as to satisfy the above conditions according to environmental temperature or environmental humidity.

Figure 3:
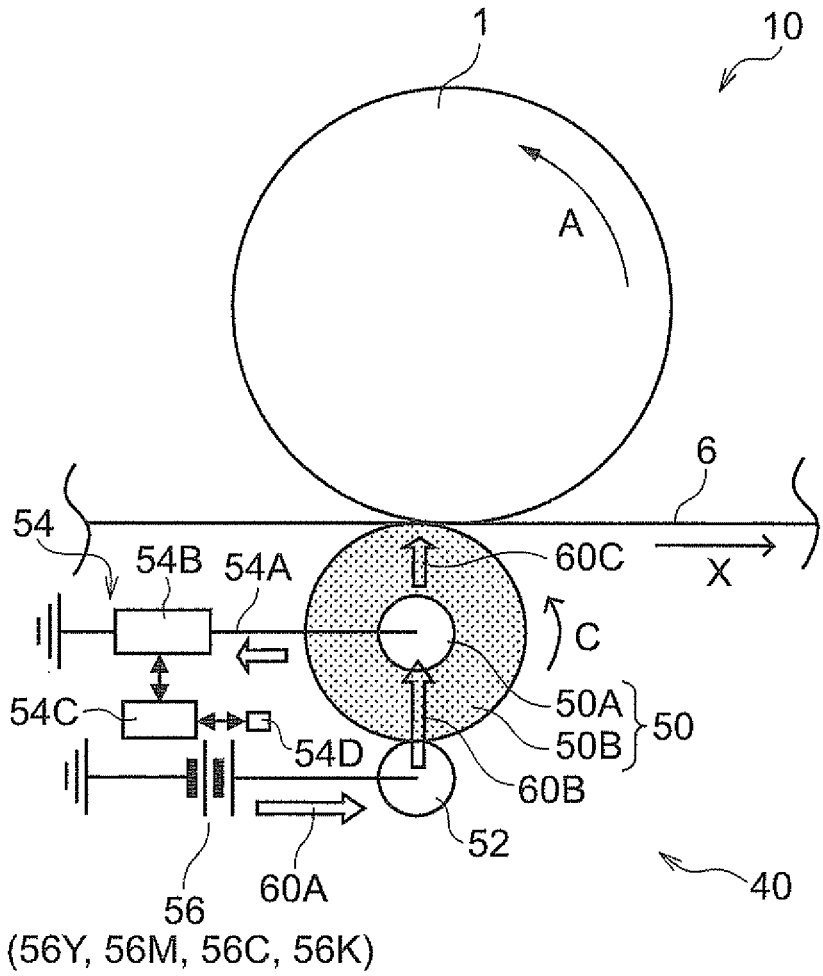
FIG. 3 is an enlarged schematic view showing the transfer device of the first exemplary embodiment of the present invention.

In a case where these setting values (resistance value, voltage value, or current value) in the adjusting device 54B are changed according to the environment or the like, for example, as shown in FIG. 3, a control member 54C which controls the resistance value, voltage value, or current value of the adjusting elements 54B is constructed so as to be electrically connected to the adjusting device 54B. Additionally, a measuring device 54D which measures environmental temperature and environmental humidity in the image forming apparatus 10 is provided in the transfer device 40, and is electrically connected to the control member 54C.

In the control member 54C, the test result from the measuring device 54D may be received at every predetermined time, and the adjusting device 54B may be controlled so as to provide the resistance value, the voltage value, or the current value, corresponding to the received test result, such that the first charge amount becomes greater than the second charge amount.

Next, the operation of the transfer device 40 related to the first embodiment will be described.

In the transfer device 40 of the present embodiment constructed as described above, when a voltage is applied from the power source 56 to the power feeding member 52 (refer to the arrow 60A in FIG. 2), charges flow toward the region (region which faces the image carrier 1) of the conductive layer 50B which comes into contact with the intermediate transfer body 6 via the core 50A from the region of the conductive layer 50B which comes into contact with the power feeding member 52 (refer to the arrow 60B and the arrow 60C in FIG. 2).

Here, the first wiring line 54A is connected to the core 50A, and the first wiring line 54A is provided with the adjusting device 54B. For this reason, some (refer to the arrow 60B in FIG. 2) of the charges which have flowed through the inside of the conductive layer 50B toward the core 50A from the region of the conductive layer 50B which comes into contact with the power feeding member 52 flow in the direction (refer to the arrow 60D in FIG. 2) toward the adjusting device 54B via the first wiring line 54A from the core 50A, and the remaining charges flow in the direction (the direction of the arrow 60C in FIG. 2) toward the region which comes into contact with the intermediate transfer body 6 from the core 50A, which results in the charges being branched in the two directions.

For this reason, by the adjusting member 54, a first charge amount of charges (refer to the arrow 60B in FIG. 2) which flow through the inside of the conductive layer 50B toward the core 50A from the region of the conductive layer 50B which comes into contact with the power feeding member 52 becomes greater than a second charge amount of charges (refer to the arrow 60C in FIG. 2) which flow through the inside of the conductive layer 50B toward the region (region which faces the image carrier 1) of the conductive layer 50B which comes into contact with the intermediate transfer body 6 from the core 50A.

That is, in the transfer device 40 of the present embodiment, when a voltage is applied from the power source 56 to the power feeding member 52, the first charge amount becomes greater than the second charge amount in the conductive layer 50B of the transfer member 50.

For this reason, even in a case where the mobility of ions within the conductive layer 50B containing an ion conductive agent has changed due to a change in environmental temperature or environmental humidity, it is presumed that polarization in the conductive layer 50B is suppressed and a change in the resistance value of the conductive layer SOB is suppressed when compared to the construction with no adjusting member 54.

Additionally, in the transfer device 40 of the present embodiment, even in a case where the mobility of ions in the conductive layer 50B has changed due to a change in environmental temperature or environmental humidity, polarization in the conductive layer SOB is suppressed. Therefore, even in a case where the polarity of a voltage to be applied to the surface (conductive layer 50B) of the transfer member 50 is positive polarity in which a change in resistance value is likely to occur, it is presumed that a change in the resistance value of the conductive layer 50B is suppressed compared to a case where the adjusting member 54 is not provided.

In addition, although description has been made in the present embodiment such that each transfer device 40 is integrally provided in the image forming apparatus 10, a construction in which the transfer device 40 is attached to and detached from the image forming apparatus 10 may be adopted.

Second Embodiment

Next, a second embodiment will be described.

In addition, since the constructions of an image forming apparatus and a transfer device related to the second embodiment are the same as the constructions of the image forming apparatus 10 and the transfer device 40 which have been described in the first embodiment, the portions of the same functions are designated by the same signs, and the detailed description thereof is omitted herein.

In the first embodiment, as for the transfer device 40, the case has been described where the adjusting member 54 adjusts the first charge amount so that the first charge amount becomes greater than the second charge amount, in the entire period when a voltage is applied to the transfer member 50 via the power feeding member 52 from the power source 56.

The present embodiment is different from the first embodiment in that an adjusting member 55 (refer to FIGS. 4 and 5) is provided instead of the adjusting member 54 in the first embodiment.

Also, the present embodiment is different from the first embodiment in that with respect to the adjusting member 55, the "integrated value" of the charge amount of charges which flow toward the core 50A from the region of the conductive layer 50B which comes into contact with the power feeding member 52 in the entire period when a voltage is applied to the transfer member 50 via the power feeding member 52 from the power source 56 is designated as the first charge amount, and the "integrated value" of the charge amount of charges which flow toward the region which comes into contact with the intermediate transfer body 6 from the core 50A is designated as the second charge amount.

Also, in the transfer device 41 (refer to FIG. 4) of the second embodiment, the adjusting member 55 functions to adjust the second charge amount so that the first charge amount which is the "integrated value" of the charge amount of charges which flow toward the core 50A from the region of the conductive layer 50B which comes into contact with the power feeding member 52 in the entire period when a voltage is applied to the transfer member 50 via the power feeding member 52 from the power source 56 becomes greater than the second charge amount which is the "integrated value" of the charge amount of charges which flow toward the region which comes into contact with the intermediate transfer body 6 from the core 50A.

In addition, in the present embodiment, the "first charge amount" represents the "integrated value" of the charge amount of charges which flow toward the core 50A from the region of the conductive layer 50B which comes into contact with the power feeding member 52 in the entire period when a voltage is applied to the transfer member 50 via the power feeding member 52 from the power source 56. However, in the following description, sometimes this integrated value may be referred to simply as the "first charge amount".

Similarly, in the present embodiment, the "second charge amount" represents the "integrated value" of the charge amount of charges which flow toward the region which comes into contact with the intermediate transfer body 6 from the core 50A in the entire period when a voltage is applied to the transfer member 50 via the power feeding member 52 from the power source 56. However, description will be made while this integrated value may be referred to simply as the "second charge amount".

Next, the transfer device 41 in the present embodiment will be described in detail.

Figure 4:
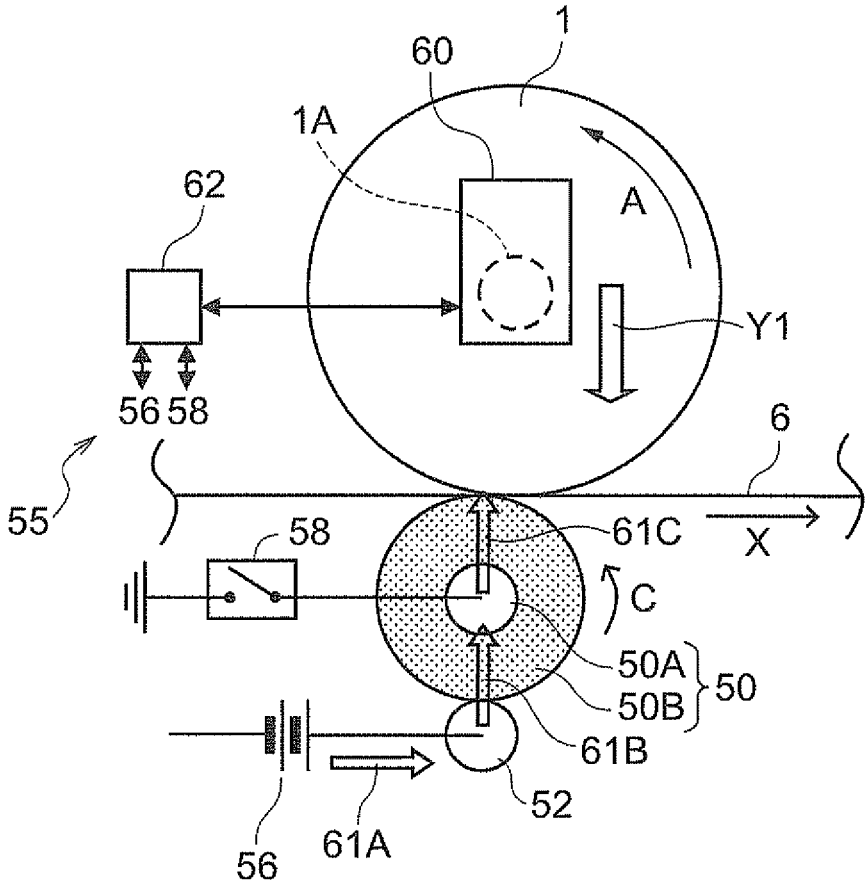
FIG. 4 is an enlarged schematic view showing a transfer device of a second exemplary embodiment of the present invention.
Figure 5:
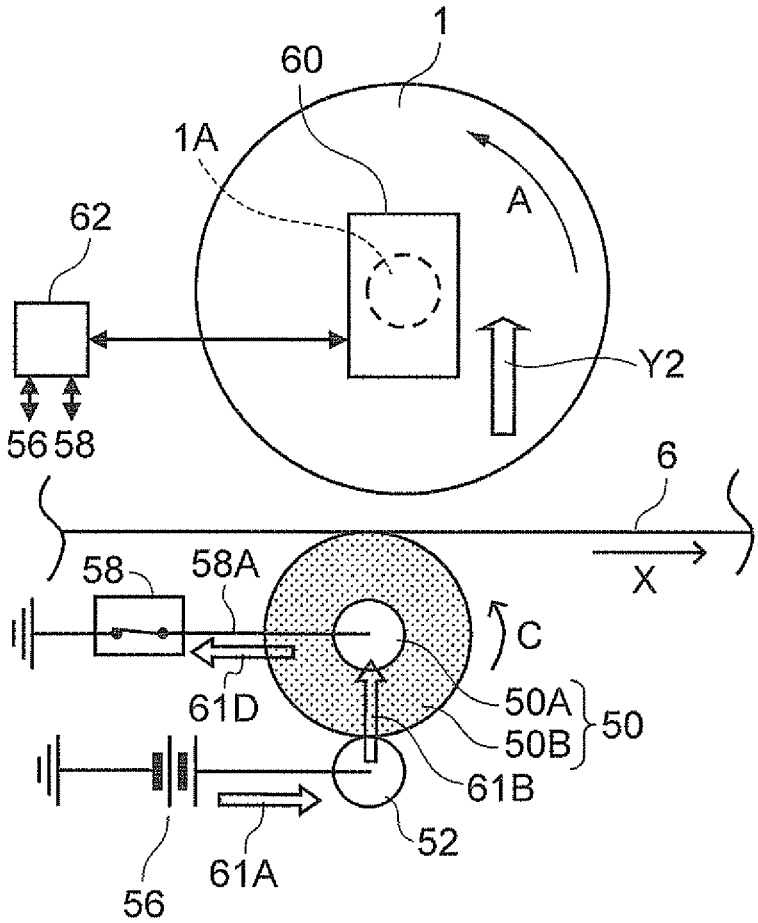
FIG. 5 is an enlarged schematic view showing the transfer device of the second exemplary embodiment of the present invention.

As shown in FIGS. 4 and 5, the transfer device 41 of the present embodiment includes the transfer member 50, the power feeding member 52, the power source 56, and the adjusting member 55 as components thereof. The transfer device 41 is mounted on the image forming apparatus 10 (refer to the transfer device 41Y, the transfer device 41M, the transfer device 41C, and transfer device 41K in of FIG. 1; Collectively they may be referred to as the transfer device 41).

As described above, the adjusting member 55 functions to make an adjustment so that, as a voltage is applied to the power feeding member 52 from the power source 56 (refer to an arrow 61A in FIG. 4), the first charge amount which is the integrated value of charges (refer to an arrow 61B in FIG. 42) which flow toward the core 50A from the region of the conductive layer 50B which comes into contact with the power feeding member 52 becomes greater than the second charge amount which is the integrated value of charges (refer to the arrow 61C in FIG. 2) which flow toward the region (region which faces the image carrier 1) of the conductive layer 50B which comes into contact with the intermediate transfer body 6 from the core 50A.

Although the adjusting member 55 may be a member having the above function, specifically, the adjusting member may include a first wiring line 58A, a switching unit 58, a movement mechanism 60, and a control unit 62. The control unit 62 is electrically connected to the switching unit 58 and movement mechanism 60.

The first wiring line 58A has one end of the wiring line connected to the core 50A and the other end grounded. The switching unit 58 is provided in the first wiring line 58A to perform switching so as to result in any one of an electrical connection state where the first wiring line 58A is electrically connected and an electrical disconnection state where the first wiring line 58A is not electrically connected. That is, the switching unit 58 brings the first wiring line 58A into an electrical connection state, thereby resulting in a state where the core 50A is grounded by the first wiring line 58A (refer to FIG. 5), and brings the first wiring line 58A into an electrical disconnection state, thereby resulting in a state (refer to FIG. 4) where the core 50A is electrically opened by the first wiring line 58A. The switching by the switching unit 58 is controlled by the control unit 62.

The movement mechanism 60 supports both longitudinal ends of a supporting member 1A provided at a position equivalent to a rotating shaft of the image carrier 1, and moves the supporting member 1A toward the direction (refer to an arrow Y1 in FIG. 4) in which the supporting member comes into contact with the transfer member 50 or the direction (refer to an arrow Y2 in FIG. 5) in which the supporting member separates from the transfer member 50. The movement mechanism 60 is controlled by the control unit 62.

In addition, the control unit 62 may be constructed so as to be electrically connected to the main control section 12 which controls the respective apparatus sections of the image forming apparatus 10 in a case where the transfer device 41 is mounted on the image forming apparatus 10 (refer to FIG. 1).

Next, the operation of the transfer device 41 related to the second embodiment will be described.

In addition, in the present embodiment, a case where the transfer device 41 is mounted on the image forming apparatus 10 and the control unit 62 is electrically connected to the main control section 12 will be described.

In the control unit 62 of the transfer device 41 of the present embodiment constructed as described above, when a signal indicating image forming processing is input from the main control section 12, the movement mechanism 60 is controlled so that the image carrier 1 is brought into the contact state of having contacted the intermediate transfer body 6 and the switching unit 58 is controlled so that the first wiring line 58A is brought into an electrical disconnection state (refer to FIG. 4). Additionally, the control unit 62 controls the power source 56 so as to start the application of a voltage to the power feeding member 52 from the power source 56.

Through this control by the control unit 62, as shown in FIG. 4, during image formation in the image forming apparatus 10, the core 50A is brought into an electrically opened state, and the image carrier 1 is brought into the state of being pressed against the transfer member 50 via the intermediate transfer body 6. Then, when a voltage is applied to the power feeding member 52 from the power source 56 in a state where the core 50A is electrically opened and in a state where the image carrier 1 is pressed against the transfer member 50 via the intermediate transfer body 6 in an approaching direction, charges flow through the inside of the conductive layer 50B toward the region which comes into contact with the intermediate transfer body 6 via the core 50A from the region of the conductive layer 50B of the conductive layer 50B which comes into contact with the power feeding member 52. At this time, since the core 50A is brought into an electrically opened state, it is presumed that, during image formation, the charge amount of charges (refer to the arrow 61B in FIG. 4) which flows toward the core 50A from the region of the conductive layer 50B which comes into contact with the power feeding member 52 becomes the same as the charge amount of charges (refer to the arrow 61C in FIG. 4) which flow toward the region of the conductive layer 50B which comes into contact with the intermediate transfer body 6 from the core 50A.

On the other hand, in the control unit 62, when a signal indicating "during image non-formation" is input from the main control section 12, the movement mechanism 60 is controlled so that the image carrier 1 is brought into the non-contact state of having separated from the intermediate transfer body 6 and the switching unit 58 is controlled so that the first wiring line 58A is brought into an electrical connection state (refer to FIG. 5). Additionally, the control unit 62 controls the power source 56 so as to start the application of a voltage to the power feeding member 52 from the power source 56.

Through this control by the control unit 62, as shown in FIG. 5, during image non-formation in the image forming apparatus 10, the first wiring line 58A is brought into an electrical connection state and the core 50A is grounded, and the image carrier 1 is brought into the state of having separated from the intermediate transfer body 6. Then, when a voltage is applied to the power feeding member 52 from the power source 56 in a state where the core 50A is grounded and the image carrier 1 is separated from the intermediate transfer body 6, the charges which have flowed toward the core 50A from the region of the conductive layer 50B which comes into contact with the power feeding member 52 do not flow in the direction toward the intermediate transfer body 6 from the core 50A, and flow toward the first wiring line 58A from the core 50A.

For this reason, it is presumed that, during image non-formation, the first charge amount (refer to the arrow 61B in FIG. 5) of charges which flow toward the core 50A from the region which comes into contact with the power feeding member 52 becomes greater than the second charge amount of charges which flow toward the region of the conductive layer 50B which comes into contact with the intermediate transfer body 6 from the core 50A. By connecting a resistance device, a constant voltage device, and a power source to the first wiring line 58A from the core 50A, it is naturally possible to control the amount of an electric current which flows thereto, or to appropriately change the amount of charges to the core 50A during image formation and during image non-formation.

Accordingly, in the transfer device 41 of the present embodiment, the first charge amount which is the "integrated value" of the charge amount of charges which flow toward the core 50A from the region of the conductive layer 50B which comes into contact with the power feeding member 52 in the entire period when a voltage is applied to the power feeding member 52 from the power source 56, becomes greater than the second charge amount which is the "integrated value" of the charge amount of charges which flow toward the region which comes into contact with the intermediate transfer body 6 from the core 50A.

For this reason, even in a case where the mobility of ions within the conductive layer 50B containing an ion conductive agent has changed due to a change in environmental temperature or environmental humidity, it is presumed that polarization in the conductive layer 50B is suppressed and a change in the resistance value of the conductive layer 50B is suppressed when compared to the construction with no adjusting member 55.

Additionally, in the transfer device 41 of the present embodiment, even in a case where the mobility of ions within the conductive layer 50B has changed due to a change in environmental temperature or environmental humidity, polarization in the conductive layer 50B is suppressed. Therefore, even in a case where the polarity of a voltage to be applied to the surface (conductive layer 50B) of the transfer member 50 is made positive, it is considered that a change in the resistance value of the conductive layer 50B is suppressed compared to a case where the adjusting member 55 is not provided.

In addition, during image non-formation, it is desirable to control a driving member (not shown) which controls the rotational driving of the image carrier 1 so as to stop the rotation of the image carrier 1, from viewpoints of suppressing physical damage, such as wear of the image carrier 1.

Additionally, although the case where a control is performed so as to result in the state (state where the first wiring line 58A is brought into an electrical connection state and the core 50A is grounded, and the image carrier 1 is separated from the intermediate transfer body 6) shown in FIG. 5 during image non-formation has been described in the present embodiment, the time for which the state shown in FIG. 5 lasts is not limited to the entire period during image non-formation, but may be only a specific period during image non-formation.

In addition, although the present embodiment has been described about a construction in which each transfer device 41 is integrally provided in the image forming apparatus 10, another construction in which the transfer device 41 is attached to and detached from the image forming apparatus 10 may be also adopted.

In addition, the case where the image forming apparatus 10 is a so-called tandem color image forming apparatus has been described in the first and second embodiments. However, the image forming apparatus in the present embodiment may be an electrophotographic image forming apparatus which primarily transfers a toner image to an intermediate transfer body (intermediate transfer body 6) from an image carrier (image carrier 1), and secondarily transfers a toner image to a recording medium P by a secondary transfer device (secondary transfer device 28), thereby forming an image on the recording medium P, without being limited to the tandem color image forming apparatus. For example, an image forming apparatus which forms a monochromatic image, and a four-cycle color image forming apparatus may be adopted.

EXAMPLES

Although the image forming apparatus of the present exemplary embodiment will be specifically described below by way of examples, the invention is not limited to these examples.

Example A and Comparative Example A

A tandem image forming apparatus (DOCU CENTRE-IV C5570, tradename, made by Fuji Xerox Co., Ltd.) shown in FIG. 1 is prepared as the image forming apparatus. In addition, a toner used for this image forming apparatus is a toner charged so as to have negative polarity.

In addition, a transfer member of the following construction is used as the transfer member (refer to the transfer member 50 in FIG. 1).

Preparation of Transfer Member A

As the transfer member A, a transfer member A serving as the transfer member 50 of the construction shown in FIG. 2 is prepared. In this transfer member, a core made of stainless steel (a conductive core with a diameter of 8 mm (core 50A)) is covered with a conductive layer (10 mm in thickness) including an urethane foaming layer containing modified fatty acid/dimethylethyl ammonium perchlorate which is a quaternary ammonium salt as an ion conductive agent.

Specifically, into a mixture of 0.15 parts by weight % of modified fatty acid/dimethylethyl ammonium perchlorate, which is a quaternary ammonium salt serving as an ion conductive agent, polyol, and isocyanate, an inert gas is introduced and mechanically stirred, thereby causing foaming, and the resultant foam is poured into a mold and cured for 30 minutes at 140° C. Then, a columnar transfer member A whose external diameter is 18 mm is obtained by polishing.

As for the transfer member A, the resistance value of the conductive layer is measured by the following method. The test results are shown in Table 1.

Measurement of Resistance Value of Conductive Layer

The resistance value of the conductive layer (refer to the conductive layer 50B in FIG. 2) of the transfer member is measured by the following method in an environment of normal temperature and normal humidity (22° C. and 55% RH).

Figure 6:
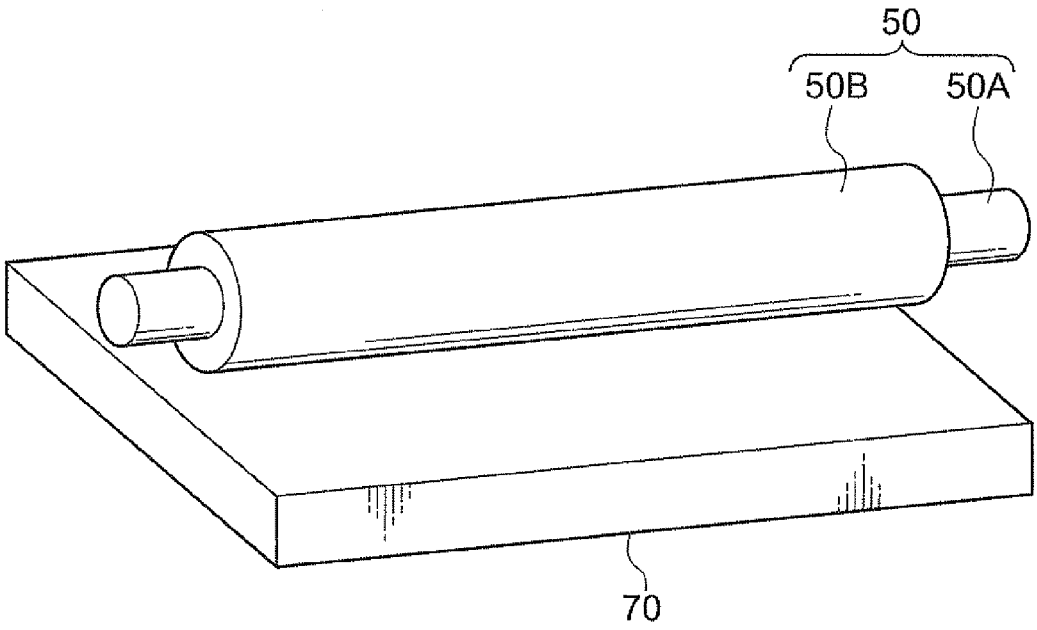
FIG. 6 is a schematic view showing a resistance value measuring method of a conductive layer of a transfer member.

In detail, as shown in FIG. 6, the transfer member 50 (transfer member A) in which the conductive layer 50B is provided is put on a metal plate 70, a load of 500 g is applied to both ends of the core 50A, respectively, a voltage is applied between the core 50A and the metal plate 70, a current value I(A) after 10 seconds is read, and the resistance value is obtained by the calculation according to the following expression. Also, the transfer member 50 is rotated by every 60° in the circumferential direction with the core 50A as a rotating shaft, a voltage is applied under the same conditions at every rotated position, the current value I is read, and the resistance value is obtained. Then, the average value of the obtained resistance is measured as the "resistance value of a conductive layer".

In addition, measurement of this resistance value is performed in cases where the voltage values of voltages applied to the core 50A are set to 100 V, 500 V, 1000 V, 2000 V, and 3000 V respectively.

Resistance Value (R) of Conductive Layer=Voltage (V)/Current (I)

Preparation of Transfer Member B

As the transfer member B, a transfer member B serving as the transfer member 50 of the construction shown in FIG. 2 is prepared. In this transfer member, a core made of stainless steel (a conductive core with a diameter of 8 mm (core 50A)) is covered with a conductive layer (10 mm in thickness) including epichlorohydrin rubber serving as an ion conductive agent, and NSR (acrylonitrile-butadiene copolymer rubber) serving as a binder.

Specifically, 70 parts by weight of epichlorohydrin rubber (GECHRON3103, trade name, made by Zeon Corporation; content of ethylene oxide: 35% by mol), and 30 parts by weight of acrylonitrile-butadiene rubber (NIPOL DN-219, trade name, made by Nippon Zeon Co., LTD.; content of acrylonitrile: 33.5% by weight) are mixed together, 1 part by weight of sulfur (made by Tsurumi Chemical Industry Co., Ltd.; 200 mesh) serving as a foaming curing agent, 1.5 parts by weight of vulcanization accelerator (NOCCELER-M, trade name, made by Ouchi Shinko Chemical Industrial Co., Ltd.), 6 parts by weight of benzene sulfonyl hydrazide serving as a foaming agent, are added and kneaded with an open roller. The kneaded mixture (rubber composition) is wound around a core shaft, and is subjected to vulcanization and foam formation for 20 minutes at 160° C., and then a conductive layer with a thickness of 10 mm is formed, and a columnar transfer member B whose external diameter is 18 mm is obtained.

As for the prepared transfer member B, the resistance value of the conductive layer is measured by the above-described method. The test results are shown in Table 1.

Preparation of Transfer Member C

Except that 0.3 parts by weight of tetraethyl ammonium tetrafluoroborate is used instead of the ion conductive agent used for preparation of the above transfer member A, a transfer member C is prepared in the same manner as the transfer member A. As for the prepared transfer member C, the resistance value of the conductive layer is measured by the above-described method. The test results are shown in Table 1.

Preparation of Transfer Member D

Except that 1 part by weight of 20% isopropanol solution of lauryl trimethyl ammonium chloride is used instead of the ion conductive agent used for preparation of the above transfer member A, a transfer member D is prepared in the same manner as the transfer member A. As for the prepared transfer member D, the resistance value of the conductive layer is measured by the above-described method. The test results are shown in Table 1.

TABLE 1

| Applied voltage when resistance value is measured (v) | Transfer member A Resistance value (Log Ω) | Transfer member B Resistance value (Log Ω) | Transfer member C Resistance value (Log Ω) | Transfer member D Resistance value (Log Ω) |
|---|---|---|---|---|
| 100 | 7.27 | 7.18 | 7.23 | 7.39 |
| 500 | 7.37 | 7.16 | 7.33 | 7.47 |
| 1000 | 7.18 | 7.13 | 7.22 | 7.27 |
| 2000 | 7.01 | 7.01 | 7.06 | 7.09 |
| 3000 | 6.91 | 6.89 | 6.98 | 7.00 |

Example 1

As a primary transfer roller, the above transfer member A is mounted on the above-prepared tandem image forming apparatus (DOCU CENTRE-IV C5570, trade name, made by Fuji Xerox Co., Ltd.) shown in FIG. 1, and the transfer member A is mounted as the transfer member 50 shown in FIG. 1. In the image forming apparatus having this construction, the same processing as the processing by the transfer device 41 (adjusting member 55) described with reference to FIGS. 4 and 5 in an environment of normal temperature and normal humidity (22° C. and 55% RH) is performed. In addition, exposure to the image carrier is not performed when this image forming apparatus is driven.

Specifically, first, the core of the transfer member A (equivalent to the transfer member 50 in FIG. 1) is brought into an electrically opened state (state shown in FIG. 4), and a constant current (positive polarity) of 90 μA is allowed to flow into a metal rod (columnar member made of stainless steel (conductive core with a diameter of 8 mm) (equivalent to the power feeding member 52)) serving as the power feeding member 52 arranged in contact with the surface of the transfer member A.

In this state, when the driving processing in which the intermediate transfer belt (equivalent to the intermediate transfer body 6 in FIG. 1), the image carrier (image carrier 1 in FIG. 1), and the transfer member A (equivalent to the transfer member 50 in FIG. 1) in this image forming apparatus are rotated at a peripheral speed of 250 mm/sec and brought into the state shown in FIG. 5 for 10 minutes every hour, is defined as 1 cycle, this driving processing is continuously performed for as many as 18 cycles. Thereby, the time for which charges flow through the inside of the conductive layer toward the side of the conductive layer which comes into contact with the intermediate transfer belt from the core is set to 18 hours.

In addition, in the state shown in FIG. 5, the core of the transfer member A is connected to a copper electric wire and grounded, and also the image carrier is brought into the state of having separated from the intermediate transfer belt (equivalent to the intermediate transfer body 6), and then the rotation of the image carrier is stopped.

Evaluation

The resistance value of the conductive layer of the transfer member A after continuous driving processing of 18 cycles in the present example is performed is measured by the above-described measuring method. Then, the difference from the resistance value (refer to Table 1) before continuous driving processing of 18 cycles in the present example is obtained, and the obtained results are shown in Table 2.

Example 2

Except that the transfer member B is used instead of the transfer member A used in the above Example 1, continuous driving processing of 18 cycles is performed under the same conditions as Example 1, and the resistance value of the conductive layer of the transfer member B after continuous driving processing of 18 cycles is performed is measured by the above-described measuring method. Then, the difference from the resistance value (refer to Table 1) before continuous driving processing of 18 cycles in the present example is obtained, and the obtained results are shown in Table 2.

Example 3

Except that the transfer member C is used instead of the transfer member A used in the above Example 1, continuous driving processing of 18 cycles is performed under the same conditions as Example 1, and the resistance value of the conductive layer of the transfer member C after continuous driving processing of 18 cycles is performed is measured by the above-described measuring method. Then, the difference from the resistance value (refer to Table 1) before continuous driving processing of 18 cycles in the present example is obtained, and the obtained results are shown in Table 2.

Example 4

Except that the transfer member D is used instead of the transfer member A used in the above Example 1, continuous driving processing of 18 cycles is performed under the same conditions as Example 1, and the resistance value of the conductive layer of the transfer member D after continuous driving processing of 18 cycles is performed is measured by the above-described measuring method. Then, the difference from the resistance value (refer to Table 1) before continuous driving processing of 18 cycles in the present example is obtained, and the obtained results are shown in Table 2.

Comparative Example 1

In the above Example 1, the same processing as the processing by the transfer device 41 (adjusting member 55) described with reference to FIGS. 4 and 5 in an environment of normal temperature and normal humidity (22° C. and 55% RH) is performed. However, the state of FIG. 4 is maintained in the present comparative example.

Specifically, the core of the transfer member A (equivalent to the transfer member 50 in FIG. 1) is brought into an electrically opened state (state shown in FIG. 4), and a constant current (positive polarity) of 90 μA is allowed to flow into a metal rod (columnar member made of stainless steel (conductive core with a diameter of 8 mm) (equivalent to the power feeding member 52)) serving as the power feeding member 52 arranged in contact with the surface of the transfer member A.

In this state, the driving processing in which the intermediate transfer belt (equivalent to the intermediate transfer body 6 in FIG. 1), the image carrier (image carrier 1 in FIG.

1), and the transfer member A (equivalent to the transfer member 50 in FIG. 1) in this image forming apparatus are rotated at a peripheral speed of 250 mm/sec, the application of a voltage to the transfer member A from the power feeding member 52 is stopped (interrupted) for 10 minutes every hour, and only the rotation of these members (the intermediate transfer belt, the image carrier, and the transfer member A) is stopped is defined as 1 cycle. Then, this driving processing of 1 cycle is continuously performed for as many as 18 cycles.

Evaluation

The resistance value of the conductive layer of the transfer member A after continuous driving processing of 18 cycles in the present comparative example is performed is measured by the above-described measuring method. Then, the difference from the resistance value (refer to Table 1) before continuous driving processing of 18 cycles in the present example is obtained, and the obtained results are shown in Table 3.

Comparative Example 2

In the above Comparative Example 1, an electric current allowed to flow into a metal rod (columnar member made of stainless steel (conductive core with a diameter of 8 mm) (equivalent to the power feeding member 52)) serving as the power feeding member 52 is set to a constant current (positive polarity) of 90 μA. However, in the present comparative example, the polarity of the electric current is reversed and an electric current allowed to flow into this metal rod is set to a low current (negative polarity) of −90 μA. Except for this point, continuous driving processing of 18 cycles is performed under the same conditions as Comparative Example 1, and the resistance value of the conductive layer of the transfer member A after continuous driving processing of 18 cycles is performed is measured by the above-described measuring method. Then, the difference from the resistance value (refer to Table 1) before continuous driving processing of 18 cycles in the present comparative example is obtained, and the obtained results are shown in Table 3.

Comparative Example 3

Except that the transfer member B is used instead of the transfer member A used in the above Comparative Example 1, continuous driving processing of 18 cycles is performed under the same conditions as Comparative Example 1, and the resistance value of the conductive layer of the transfer member B after continuous driving processing of 18 cycles is performed is measured by the above-described measuring method. Then, the difference from the resistance value (refer to Table 1) before continuous driving processing of 18 cycles in the present comparative example is obtained, and the obtained results are shown in Table 3.

Comparative Example 4

Except that the transfer member B is used instead of the transfer member A used in the above Comparative Example 2, continuous driving processing of 18 cycles is performed under the same conditions as Comparative Example 2, and the resistance value of the conductive layer of the transfer member B after continuous driving processing of 18 cycles is performed is measured by the above-described measuring method. Then, the difference from the resistance value (refer to Table 1) before continuous driving processing of 18 cycles in the present comparative example is obtained, and the obtained results are shown in Table 3.

Comparative Example 5

Except that the transfer member C is used instead of the transfer member A used in the above Comparative Example 1, continuous driving processing of 18 cycles is performed under the same conditions as Comparative Example 1, and the resistance value of the conductive layer of the transfer member C after continuous driving processing of 18 cycles is performed is measured by the above-described measuring method. Then, the difference from the resistance value (refer to Table 1) before continuous driving processing of 18 cycles in the present comparative example is obtained, and the obtained results are shown in Table 3.

Comparative Example 6

Except that the transfer member B is used instead of the transfer member A used in the above Comparative Example 2, continuous driving processing of 18 cycles is performed under the same conditions as Comparative Example 2, and the resistance value of the conductive layer of the transfer member B after continuous driving processing of 18 cycles is performed is measured by the above-described measuring method. Then, the difference from the resistance value (refer to Table 1) before continuous driving processing of 18 cycles in the present comparative example is obtained, and the obtained results are shown in Table 3.

Comparative Example 7

Except that the transfer member D is used instead of the transfer member A used in the above Comparative Example 1, continuous driving processing of 18 cycles is performed under the same conditions as Comparative Example 1, and the resistance value of the conductive layer of the transfer member D after continuous driving processing of 18 cycles is performed is measured by the above-described measuring method. Then, the difference from the resistance value (refer to Table 1) before continuous driving processing of 18 cycles in the present comparative example is obtained, and the obtained results are shown in Table 3.

Comparative Example 8

Except that the transfer member D is used instead of the transfer member A used in the above Comparative Example 2, continuous driving processing of 18 cycles is performed under the same conditions as Comparative Example 2, and the resistance value of the conductive layer of the transfer member D after continuous driving processing of 18 cycles is performed is measured by the above-described measuring method. Then, the difference from the resistance value (refer to Table 1) before continuous driving processing of 18 cycles in the present comparative example is obtained, and the obtained results are shown in Table 3.

Example 5

The above transfer member A is mounted on the p above-prepared tandem image forming apparatus (DOCU CENTRE-IV C5570, trade name, made by Fuji Xerox Co., Ltd) shown in FIG. 1, as a primary transfer roller, and the transfer member A is mounted as the transfer member 50 shown in FIG. 1. In the image forming apparatus having this construction, the same processing as the processing by the transfer device 40 (adjusting member 54) described with reference to FIG. 2 in an environment of normal temperature and normal humidity (22° C. and 55% RH) is performed. In addition, exposure to the image carrier is not performed when this image forming apparatus is driven.

Specifically, first, one end of a copper electric wire (equivalent to the first wiring line 54A) is connected to the core of the transfer member A (equivalent to the transfer member 50 in FIG. 1), and the other end of this copper electric wire is grounded. Then, a resistance device (FP TYPE, trade name, made by JAPAN FINECHEM COMPANY, INC.) whose resistance value is 75 MΩ is provided as the adjusting device 54B at the longitudinal central portion of this copper electric wire. This brings the core of the transfer member A into a grounded state via the resistance device.

Then, a constant current (positive polarity) of 110 μA is allowed to flow into a metal rod (columnar member made of stainless steel (conductive core with a diameter of 8 mm) (equivalent to the power feeding member 52)) serving as the power feeding member 52 arranged in contact with the surface of the transfer member A. At this time, the electric current which flows into this copper electric wire (equivalent to the first wiring line 54A) is 20 μA. For this reason, the charges (110 μA) which flow toward the core from the region in the conductive layer of the transfer member A which comes into contact with the power feeding member 52 is made greater than the charges (90 μA) in the conductive layer which flow toward the intermediate transfer belt (intermediate transfer body 6) from this core (state shown in FIG. 2).

In this state, the driving processing in which the intermediate transfer belt (equivalent to the intermediate transfer body 6 in FIG. 1), the image carrier (image carrier 1 in FIG. 1), and the transfer member A (equivalent to the transfer member 50 in FIG. 1) in this image forming apparatus are rotated at a peripheral speed of 250 min/sec is continuously performed for 18 hours. Thereby, the time for which charges flow through the inside of the conductive layer toward the side of the conductive layer which comes into contact with the intermediate transfer belt from the core is set to 18 hours.

Evaluation

The resistance value of the conductive layer of the transfer member A after continuous driving processing for 18 hours in the present example is performed is measured by the above-described measuring method. Then, the difference from the resistance value (refer to Table 1) before continuous driving processing for 18 hours in the present example is obtained, and the obtained results are shown in Table 2.

Example 6

Except that the transfer member B is used instead of the transfer member A used in the above Example 5, continuous driving processing for 18 hours is performed under the same conditions as Example 5, and the resistance value of the conductive layer of the transfer member B after continuous driving processing for 18 hours is performed is measured by the above-described measuring method. Then, the difference from the resistance value (refer to Table 1) before continuous driving processing for 18 hours in the present example is obtained, and the obtained results are shown in Table 2.

Example 7

In the above Example 5, the resistance device is used as the adjusting device 54B. However, in the present example, except that a constant voltage device (CERAMIC VARISTOR TNR, trade name, made by NIPPON CHEMI-CON CORP.) whose constant voltage value is 1500 V is used instead of this resistance device e, continuous driving processing for 18 hours is performed under the same conditions as Example 5, and the resistance value of the conductive layer of the transfer member A after continuous driving processing for 18 hours is performed is measured by the above-described measuring method. Then, the difference from the resistance value (refer to Table 1) before continuous driving processing for 18 hours in the present example is obtained, and the obtained results are shown in Table 2. In addition, the constant voltage value of this constant voltage device is a value set so as to be the same (1500 V) as the potential of the core of this transfer member A when a voltage with the same voltage value as a voltage to be applied via the power feeding member 52 during driving processing is applied via the power feeding member 52 to the transfer member A before the continuous driving processing is performed.

Example 8

Except that the transfer member B is used instead of the transfer member A used in the above Example 7, continuous driving processing for 18 hours is performed under the same conditions as Example 7, and the resistance value of the conductive layer of the transfer member B after continuous driving processing for 18 hours is performed is measured by the above-described measuring method. Then, the difference from the resistance value (refer to Table 1) before continuous driving processing for 18 hours in the present example is obtained, and the obtained results are shown in Table 2.

TABLE 2

| | Example 1 | Example 2 | Example 3 | Example 4 | Example 5 | Example 6 | Example 7 | Example 8 |
|---|---|---|---|---|---|---|---|---|
| Transfer member | Transfer member A | Transfer member B | Transfer member C | Transfer member D | Transfer member A | Transfer member B | Transfer member A | Transfer member B |
| Polarity of voltage to be applied to transfer member from power feeding member | Positive | | | | Positive | | Positive | |
| Driving Environment | 22° C. and 55% RH | | | | 22° C. and 55% RH | | 22° C. and 55% RH | |
| Relationship between first charge amount A and second charge amount B | — | | | | A > B | | A > B | |
| Relationship between first charge amount A and second charge amount B when first charge amount A is integrated value and second charge amount B is integrated value | A > B | | | | — | | — | |
| Type of adjusting element (adjusting | — | | | | Resistance device | | Constant voltage device | |

TABLE 2-continued

| | | | | Example 1 | Example 2 | Example 3 | Example 4 | Example 5 | Example 6 | Example 7 | Example 8 |
|---|---|---|---|---|---|---|---|---|---|---|---|
| element 54B) | | | | | | | | | | | |
| Evaluation | Difference in resistance value of conductive layer between before and after driving processing (Log Ω) | Applied voltage when resistance is measured | 100 V | 0.02 | 0.02 | 0.04 | 0.15 | −0.04 | 0.00 | 0.08 | 0.06 |
| | | | 500 V | −0.05 | −0.02 | 0 | 0.17 | 0.00 | 0.01 | 0.06 | 0.04 |
| | | | 1000 V | 0.03 | −0.01 | 0.03 | 0.16 | 0.03 | −0.02 | 0.00 | 0.02 |
| | | | 2000 V | 0.02 | −0.04 | 0.03 | 0.09 | 0.03 | −0.04 | −0.01 | −0.01 |
| | | | 3000 V | 0.00 | 0.01 | 0.03 | 0.07 | −0.02 | −0.02 | 0.02 | 0.00 |
| | | Average | | 0.00 | −0.01 | 0.03 | 0.13 | 0.00 | −0.01 | 0.03 | 0.02 |

stainless steel (conductive core with a diameter of 8 mm)

TABLE 3

| | | | | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|---|---|
| Transfer member | | | | Transfer member A | Transfer member A | Transfer member B | Transfer member B | Transfer member C | Transfer member C | Transfer member D | Transfer member D |
| Polarity of voltage to be applied to transfer member from power feeding member | | | | Positive | Negative | Positive | Negative | Positive | Negative | Positive | Negative |
| Driving Environment | | | | 22° C. and 55% RH | | | | | | | |
| Relationship between first charge amount A and second charge amount B | | | | A ≤ B | | | | | | | |
| Relationship between first charge amount A and second charge amount B when first charge amount A is integrated value and second charge amount B is integrated value | | | | A ≤ B | | | | | | | |
| Type of adjusting device (adjusting device 54B) | | | | — | | | | | | | |
| Evaluation | Difference in resistance value of conductive layer between before and after driving processing (LogΩ) | Applied voltage when resistance is measured | 100 V | 0.34 | 0.04 | 0.52 | −0.03 | 0.41 | 0.15 | 0.86 | 0.15 |
| | | | 500 V | 0.19 | −0.07 | 0.38 | 0.02 | 0.31 | 0.09 | 0.82 | 0.14 |
| | | | 1000 V | 0.21 | 0.07 | 0.22 | 0.01 | 0.31 | 0.09 | 0.52 | 0.17 |
| | | | 2000 V | 0.22 | 0.02 | 0.20 | −0.06 | 0.23 | 0.08 | 0.41 | 0.13 |
| | | | 3000 V | 0.21 | −0.01 | 0.19 | −0.02 | 0.17 | 0.05 | 0.33 | 0.11 |
| | | Average | | 0.23 | 0.01 | 0.30 | −0.02 | 0.29 | 0.09 | 0.59 | 0.14 |

Example 9

The above transfer member A is mounted on the above-prepared tandem image forming apparatus (DOCU CENTRE-IV C5570, trade name, made by Fuji Xerox Co., Ltd) shown in FIG. 1, as a primary transfer roller, and the transfer member A is mounted as the transfer member 50 shown in FIG. 1. In the image forming apparatus having this construction, the same processing as the processing by the transfer device 40 (adjusting member 54) described with reference to FIG. 2 in an environment of low temperature and low humidity (10° C. and 15% RH) and in an environment of high temperature and high humidity (28° C. and 85% RH) is performed. In addition, exposure to the image carrier is not performed when this image forming apparatus is driven.

Specifically, first, one end of a copper electric wire (equivalent to the first wiring line 54A) is connected to the core of the transfer member A (equivalent to the transfer member 50 in FIG. 1), and the other end of this copper electric wire is grounded. Then, a constant current source (610D (trade name) made by Trek, Inc.) capable of changing the value of an electric current to be generated is provided as the adjusting device 54B at the longitudinal central portion of this copper electric wire.

Then, a constant current (positive polarity) of 110 μA is allowed to flow into a metal rod (columnar member made of (equivalent to the power feeding member 52)) serving as the power feeding member 52 arranged in contact with the surface of the transfer member A. Then, the current value of the constant current source provided as the adjusting element 54B is adjusted so that the electric current which flows into this copper electric wire (equivalent to the first wiring line 54A) from the core (the core 50A) always becomes 20 μA.

For this reason, in the present example, an adjustment is made so that the charges (110 μA) which flow toward the core from the region in the conductive layer of the transfer member A which comes into contact with the power feeding member 52 are made greater than the charges (90 μA) in the conductive layer which flow toward the intermediate transfer belt (intermediate transfer body 6) from this core, and also the difference of this charge amount is maintained during driving processing (state shown in FIG. 2).

In this state, the driving processing in which the intermediate transfer belt (equivalent to the intermediate transfer body 6 in FIG. 1), the image carrier (image carrier 1 in FIG. 1), and the transfer member A (equivalent to the transfer member 50 in FIG. 1) in this image forming apparatus are rotated at a peripheral speed of 250 mm/sec is continuously performed for 18 hours. Thereby, the time for which charges flow through the inside of the conductive layer toward the side of the conductive layer which comes into contact with the intermediate transfer belt from the core is set to 18 hours.

Evaluation

In the present example, in the environment of low temperature and low humidity (10° C. and 15% RH) and in the environment of high temperature and high humidity (28° C. and 85% RH), the resistance value of the conductive layer of the transfer member A after continuous driving processing for 18 hours is performed is measured by the above-described measuring method. Then, the difference from the resistance value (refer to Table 1) before continuous driving processing for 18 hours in the present example is obtained, and the obtained results are shown in Table 4.

Example 10

Except that the transfer member B is used instead of the transfer member A used in the above Example 9, continuous driving processing for 18 hours is performed in an environment of low temperature and low humidity (10° C. and 15% RH) and in an environment of high temperature and high humidity (28° C. and 85% RH) under the same conditions as Example 9, and the resistance value of the conductive layer of the transfer member B after continuous driving processing for 18 hours is performed is measured by the above-described measuring method. Then, the difference from the resistance value (refer to Table 1) before continuous driving processing for 18 hours in the present example is obtained, and the obtained results are shown in Table 4.

Additionally, as shown in Table 3, in a case where when a positive voltage is applied to the conductive layer of the transfer member, a change in the resistance value of the conductive layer is larger (comparison results between Comparative Example 1 and Comparative Example 2 and between Comparative Example 3 and Comparative Example 4) than the case where a negative voltage is applied. However, as shown in Tables 2 and 3, even in a case where a positive voltage with a large change in this resistance value is applied, a change in resistance value is suppressed in the corresponding Examples 1 and 2 when compared to Comparative Examples 1 and 3.

Additionally, as shown in Table 2, a change in the resistance value of the conductive layer is further suppressed in Examples 5 to 8 using the construction of the transfer device 40 shown in FIG. 2 as a transfer device when compared to Examples 1 and 4 using the construction of the transfer device 41 shown in FIGS. 4 and 5 as a transfer device.

Additionally, as shown in Tables 2 and 4, a change in the resistance value of the conductive layer is further suppressed in the examples using the constant voltage device and the constant current source as the adjusting device 54B shown in FIG. 2 when compared to the examples using the resistance device as the adjusting device. Additionally, as shown in Table 2 and 4, change in the resistance value of the conductive layer is further suppressed in the examples in which the value of an electric current to be generated is adjusted using the constant current source as the adjusting element 54B shown in FIG. 2, when compared to the examples using the constant voltage element as the adjusting device.

TABLE 4

| | | | | Example 9 | | Example 10 | |
|---|---|---|---|---|---|---|---|
| Transfer member | | | | Transfer member A | | Transfer member B | |
| Polarity of voltage to be applied to transfer member from power feeding member | | | | Positive | | | |
| Driving Environment | | | | 10° C. and 15% RH | 28° C. and 85% RH | 10° C. and 15% RH | 28° C. and 85% RH |
| Relationship between first charge amount A and second charge amount B | | | | A > B | | | |
| Relationship between first charge amount A and second charge amount B when first charge amount A is integrated value and second charge amount B is integrated value | | | | — | | | |
| Type of adjusting device (adjusting device 54B) | | | | Constant current source | | | |
| Evaluation | Difference in resistance value of conductive layer between before and after driving processing (log Ω) | Applied voltage when resistance is measured | 100 V | 0.02 | 0.19 | 0.04 | 0.30 |
| | | | 500 V | 0.01 | 0.08 | 0.03 | 0.19 |
| | | | 1000 V | 0 | 0.06 | 0.02 | 0.10 |
| | | | 2000 V | 0.01 | 0.06 | 0.03 | 0.08 |
| | | | 3000 V | −0.01 | 0.07 | 0.02 | 0.04 |
| | | Average | | 0.01 | 0.09 | 0.03 | 0.14 |

Example 1 and Comparative Example 1 are different from each other in that the same processing as the processing by the transfer device 41 (adjusting member 55) described with reference to FIGS. 4 and 5 is performed in Example 1, and the state of FIG. 4 is maintained in Comparative Example 1. As shown in Tables 2 and 3, a change in the resistance of the conductive layer is suppressed in Example 1 when compared to Comparative Example 1.

Similarly, Example 2 and Comparative Example 3 are different from each other in that the same processing as the processing by the transfer device 41 (adjusting member 55) described with reference to FIGS. 4 and 5 is performed in Example 2, and the state of FIG. 4 is maintained in Comparative Example 3. As shown in Tables 2 and 3, a change in the resistance value of the conductive layer is suppressed in Example 2 when compared to Comparative Example 3.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising a transfer member, that is arranged so as to face an image carrier that carries a toner image on a surface thereof via a transfer-receiving member, the transfer member comprising a conductive layer comprising an ion conductive agent on a conductive core, and that transfers the toner image carried on the surface of the image carrier to the transfer-receiving member;

a voltage application unit, that is arranged in contact with a surface of the transfer member, and that applies a voltage to the transfer member from the surface thereof; and an adjusting unit that adjusts a second charge amount so that a first charge amount of charges that flow toward the conductive core from the region of the conductive layer that comes into contact with the voltage application unit, becomes greater than the second charge amount of charges that flow toward a region of the conductive layer that faces the image carrier from the conductive core, due to a voltage being applied to the transfer member from the voltage application unit.

2. The transfer device according to claim 1, wherein the adjusting unit comprises:

a first wiring line that grounds the core; and a first adjusting unit that adjusts a charge amount of charges that flow into the first wiring line so that some of charges, flowing toward the conductive core from the region of the conductive layer that comes into contact with the voltage application unit, flow toward the first wiring line via the core.

3. The transfer device according to claim 2, wherein the first adjusting unit comprises any of a resistance device, a constant voltage device, or a constant current source.

4. The transfer device according to claim 1, wherein the adjusting unit comprises:

a first wiring line that grounds the conductive core;

a switching unit that switches the first wiring line to an electrical connection state or an electrical disconnection state;

a moving unit that moves the image carrier so that the image carrier is brought into a contact state of contacting the transfer-receiving member or a non-contact state of being separated from the transfer-receiving member; and a control unit that controls the switching unit and the moving unit so that the first wiring line is brought into the electrical disconnection state and the image carrier is brought into the contact state at a time of image formation when the toner image carried on the image carrier is transferred to the transfer-receiving member, and that controls the switching unit and the moving unit so that the first wiring line is brought into the electrical connection state and the image carrier is brought into the non-contact state at times of image non-formation that are other than the time of image formation.

5. The transfer device according to claim 1, wherein: the transfer-receiving member is an intermediate transfer body;

the voltage application unit comprises a power feeding member and a power source; and the adjusting unit adjusts the second charge amount so that the first charge amount, which is an integrated value of a charge amount of charges that flow toward the conductive core from the region of the conductive layer that comes into contact with the power feeding member in an entire period when a voltage is applied to the transfer member via the power feeding member from the power source, becomes greater than the second charge amount, which is an integrated value of the charge amount of charges that flow toward the region that is brought into contact with the intermediate transfer body from the conductive core.

6. The transfer device according to claim 1, wherein the adjusting unit adjusts the second charge amount so that the first charge amount falls within the range of from about 1.1 times to about 2 times the second charge amount.

7. The transfer device according to claim 1, wherein the adjusting unit adjusts the second charge amount so that the first charge amount falls within the range of from about 1.1 times to about 1.5 times the second charge amount.

8. The transfer device according to claim 1, wherein the ion conductive agent comprises at least one compound selected from the group consisting of quaternary ammonium salts, aliphatic sulfonates, higher alcohol sulfate ester salts, higher alcohol-ethylene-oxide-added sulfate ester salts, higher alcohol phosphoric acid ester salts, higher alcohol-ethylene-oxide-added phosphoric acid ester salts, betaines, higher alcohol ethylene oxides, polyethylene glycol fatty acid esters, and polyhydric alcohol fatty acid esters.

9. The transfer device according to claim 1, wherein the ion conductive agent comprises at least one quaternary ammonium salt.

10. The transfer device according to claim 9, wherein the quaternary ammonium salt comprises modified fatty acid/dimethylethyl ammonium perchlorate, tetraethyl ammonium tetrafluoroborate, or lauryl trimethyl ammonium chloride.

11. The transfer device according to claim 1, wherein the conductive layer comprises the ion conductive agent dispersed in a binder material.

12. The transfer device according to claim 1, wherein the conductive layer comprises a urethane foam layer comprising the ion conductive agent.

13. The transfer device according to claim 1, wherein the conductive layer comprises an epichlorohydrin rubber and an acrylonitrile-butadiene copolymer rubber.

14. The transfer device according to claim 1, wherein the conductive core comprises stainless steel.

15. The transfer device according to claim 1, wherein a toner of the toner image is charged so as to have negative polarity.

16. An image forming apparatus comprising the transfer device according to claim 1.

17. The image forming apparatus according to claim 16, wherein the transfer device is attached to and detached from the image forming apparatus.

* * * * *